US007748758B2

(12) United States Patent
Fang et al.

(10) Patent No.: US 7,748,758 B2
(45) Date of Patent: Jul. 6, 2010

(54) CYLINDER LOCK HAVING IMPROVED TORSIONAL STRENGTH

(75) Inventors: Jeff Fang, Chia-Yi (TW); Cheng-Chung Liu, Chia-Yi County (TW); Lan-Kun Don, Chia-Yi (TW)

(73) Assignee: Tong-Lung Metal Industry Co., Ltd., Chia-Yi (TW)

( * ) Notice: Subject to any disclaimer, the term of this patent is extended or adjusted under 35 U.S.C. 154(b) by 659 days.

(21) Appl. No.: 11/652,834

(22) Filed: Jan. 12, 2007

(65) Prior Publication Data

US 2007/0182169 A1 Aug. 9, 2007

(30) Foreign Application Priority Data

Jan. 16, 2006 (TW) ..... 95201062 U

(51) Int. Cl.
*E05B 1/00* (2006.01)
*G05G 5/00* (2006.01)

(52) U.S. Cl. ..... 292/347; 70/224; 292/DIG. 64

(58) Field of Classification Search ..... 292/347, 292/DIG. 64; 70/224
See application file for complete search history.

(56) References Cited

U.S. PATENT DOCUMENTS

| | | | | | |
|---|---|---|---|---|---|
| 323,393 | A * | 8/1885 | Bullard | 70/452 |
| 2,538,688 | A | 1/1951 | Heyer | |
| 4,201,069 | A * | 5/1980 | Katayama et al. | 70/422 |
| 4,428,212 | A * | 1/1984 | Best et al. | 70/224 |
| 5,335,948 | A | 8/1994 | Norton, II et al. | |
| 5,845,522 | A * | 12/1998 | Shen | 70/224 |
| 6,141,998 | A * | 11/2000 | Seo | 70/224 |
| 6,470,721 | B2 | 10/2002 | Ming | |
| 6,497,126 | B2 * | 12/2002 | Wang | 70/472 |
| 6,553,799 | B2 * | 4/2003 | Bates et al. | 70/224 |
| 6,615,630 | B2 * | 9/2003 | Wu et al. | 70/472 |
| 6,698,803 | B2 * | 3/2004 | Furlong | 292/165 |
| 6,893,059 | B2 * | 5/2005 | Shen | 292/169 |
| 6,935,148 | B2 * | 8/2005 | Don | 70/472 |
| 7,066,507 | B2 * | 6/2006 | Don | 292/336.3 |
| 2001/0023600 | A1 * | 9/2001 | Pompeii | 70/224 |
| 2002/0104345 | A1 * | 8/2002 | Wang | 70/472 |
| 2003/0056556 | A1 * | 3/2003 | Park et al. | 70/224 |
| 2004/0168491 | A1 * | 9/2004 | Simon et al. | 70/224 |
| 2004/0187531 | A1 * | 9/2004 | Simon et al. | 70/224 |
| 2006/0042333 | A1 * | 3/2006 | Wu | 70/224 |
| 2007/0028657 | A1 | 2/2007 | Huang et al. | |
| 2007/0096479 | A1 | 5/2007 | Lin et al. | |
| 2008/0168809 | A1 * | 7/2008 | Liu et al. | 70/224 |
| 2009/0025438 | A1 * | 1/2009 | Don et al. | 70/224 |

* cited by examiner

*Primary Examiner*—Carlos Lugo
(74) *Attorney, Agent, or Firm*—Chun-Ming Shih

(57) ABSTRACT

A cylinder lock includes a latch retractor housing having inner and outer cover plates, inner and outer drive spindles extending respectively through the inner and outer cover plates, a sleeve surrounding the outer drive spindle and having a flange contacting the outer cover plate, an outer shell surrounding the inner drive spindle and the latch retractor housing, and at least one rigid coupling member or tube disposed within the outer shell and engaging and coupling together the inner and outer cover plates and the flange, thereby reinforcing the outer drive spindle and the latch retractor housing and increasing torsional and compression strengths thereof. A reinforcing ring is further provided to couple the outer drive spindle to the outer handle for reinforcement.

18 Claims, 5 Drawing Sheets

CYLINDER LOCK HAVING IMPROVED TORSIONAL STRENGTH

CROSS-REFERENCE TO RELATED APPLICATION

This application claims priority of Taiwanese Application No. 095201062, filed on Jan. 16, 2006.

BACKGROUND OF THE INVENTION

1. Field of the Invention

The invention relates to a cylinder lock mountable on a door panel to control a latch, more particularly to a cylinder lock having improved mechanical strengths to bear against high torsional, compression and tensile stresses.

2. Description of the Related Art

A cylinder lock typically includes a drive mechanism that can be operated through an inner or outer handle so as to retract a door latch to an unlatching position. The drive mechanism generally includes inner and outer drive spindles connected respectively to the inner and outer handles, and a latch retractor connected to the inner and outer drive spindles and coupled to the door latch. When the inner or outer handle is rotated, the rotational movement thereof is transmitted to the inner or outer drive spindle, and the latch retractor moves the door latch to the unlatching position. However, the inner and outer drive spindles are prone to damage when a torque is applied improperly or excessively to the inner or outer handle.

U.S. Pat. No. 6,893,059 discloses a cylinder lock that has two axially extending mounting rods to reinforce torsional strength of a drive mechanism. Each of the mounting rods has two ends fixed to inner and outer rose liners of the cylinder lock, and is embedded partially and axially in an outer shell of the drive mechanism so that a portion of each mounting rod protrudes from the outer shell of the drive mechanism. To assemble the drive mechanism in a door panel, in addition to a cylindrical lock hole formed in the door panel to receive the drive mechanism, positioning grooves are provided in the door panel at two diametrically opposed positions of the cylindrical lock hole for receiving partially the mounting rods. As the outer shell of the drive mechanism is coupled rigidly to the inner and outer rose liners through the mounting rods, the outer shell of the drive mechanism has an increased torsional strength to bear the torque applied to the drive mechanism. However, the mounting rods are insufficient to strengthen interior component parts of the drive mechanism, such as a latch retractor housing, disposed within the outer shell.

SUMMARY OF THE INVENTION

Therefore, an object of the present invention is to provide a cylinder lock with a reinforcement that strengthen interior component parts disposed within an outer shell of a drive mechanism that is used to operate a latch.

According to an aspect of the present invention, the present invention provides a cylinder lock which comprises: a latch retractor adapted to be connected to a latch; a latch retractor housing receiving the latch retractor and having an inner cover plate; and inner and outer drive spindles extending into the latch retractor housing to operate the latch retractor. The inner drive spindle extends through the inner cover plate. The cylinder lock further comprises a sleeve, an outer shell, and at least one rigid coupling member. The sleeve is connected to the latch retractor housing, surrounds the outer drive spindle, and has a flange projecting radially from the sleeve and opposite to the inner cover plate. The outer shell surrounds the inner drive spindle and is associated with the sleeve to encase the latch retractor housing. The rigid coupling member is disposed within the outer shell and engages the inner cover plate and the flange. The rigid coupling member is offset from and is substantially parallel to a rotation axis of the inner and outer drive spindles.

According to another aspect of the present invention, a cylinder lock having a drive mechanism, comprises: an outer handle having a tubular end portion; an outer drive spindle connected to the tubular end portion, adapted to transmit a torque from the outer handle to the drive mechanism, and having a portion inserted into the tubular end portion; a reinforcing ring sleeved around another portion of the outer drive spindle and having two opposite ends respectively engaging the tubular end portion and the another portion of the outer drive spindle.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
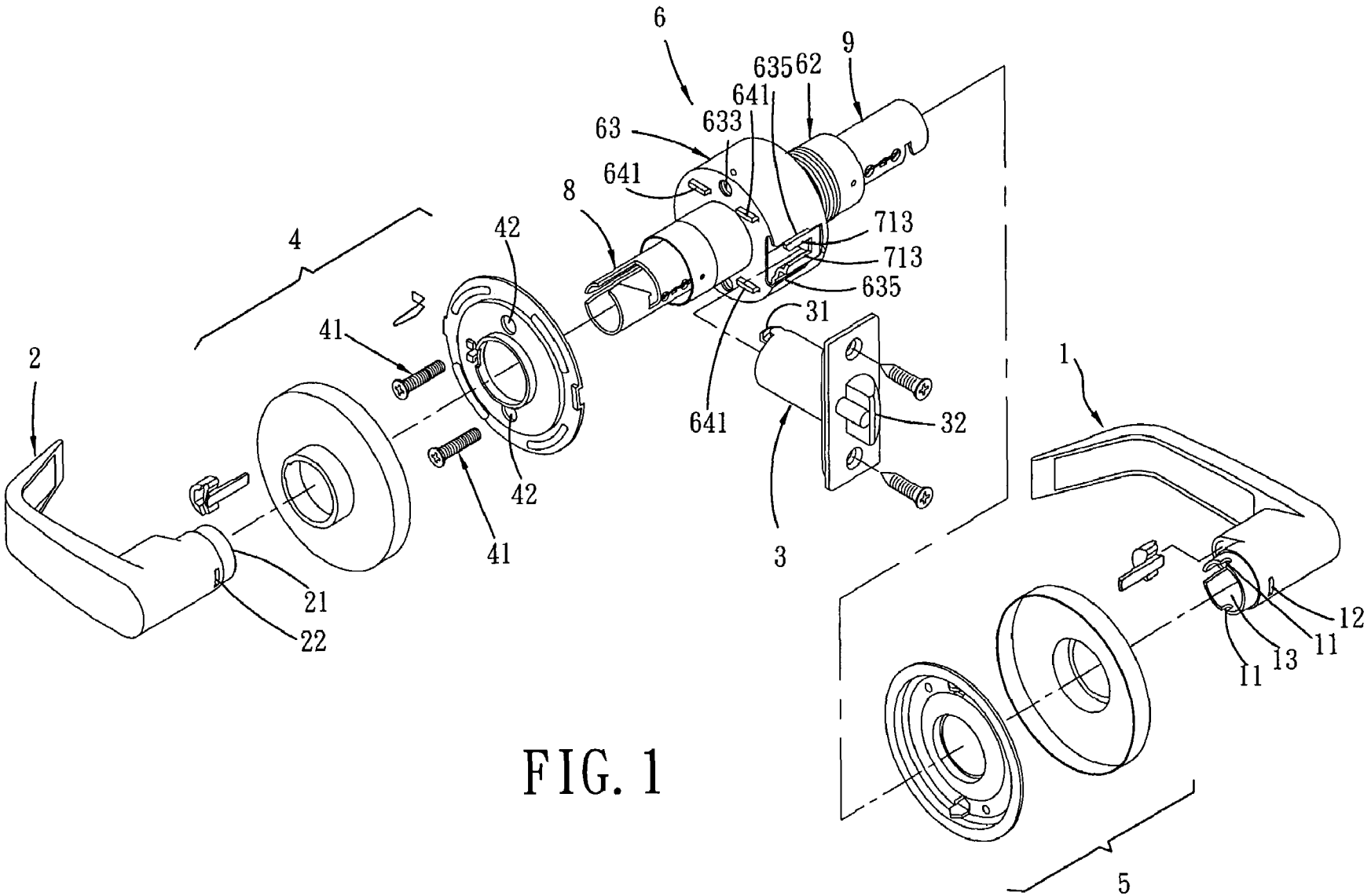
FIG. 1 is an exploded view of a cylinder lock embodying the present invention.

Referring to FIG. 1, there is shown a cylinder lock mountable on a door panel and including a drive mechanism 6 having an inner end connected to an inner rose 4 and an inner handle 2, and an outer end connected to an outer rose 5 and an outer handle 1.

Figure 2:
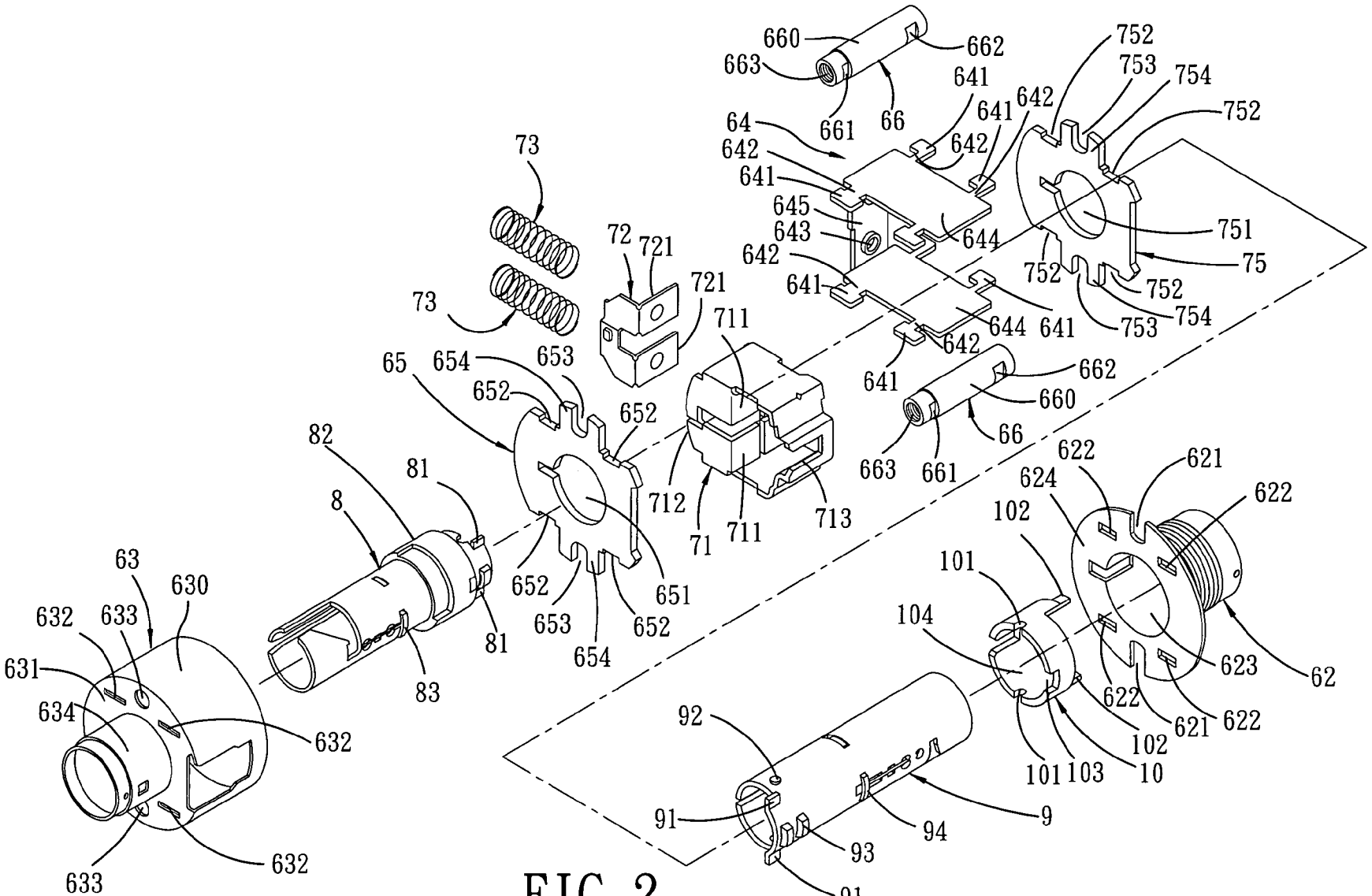
FIG. 2 is an exploded view showing all component parts of a drive mechanism of the cylinder lock in an unassembled state.
Figure 3:
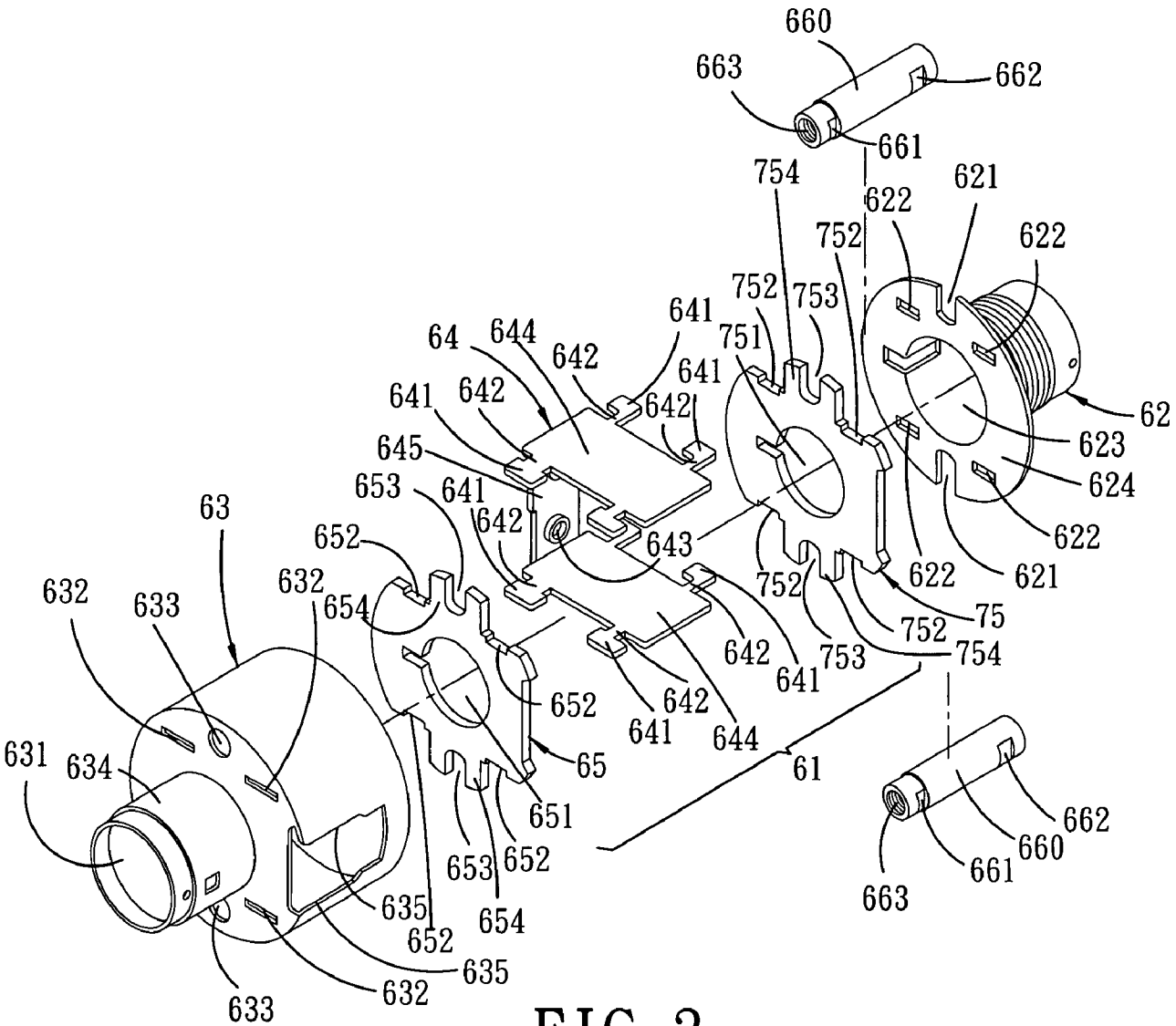
FIG. 3 is another exploded view showing the unassembled component parts of the drive mechanism except inner and outer drive spindles and a latch retractor.
Figure 4:
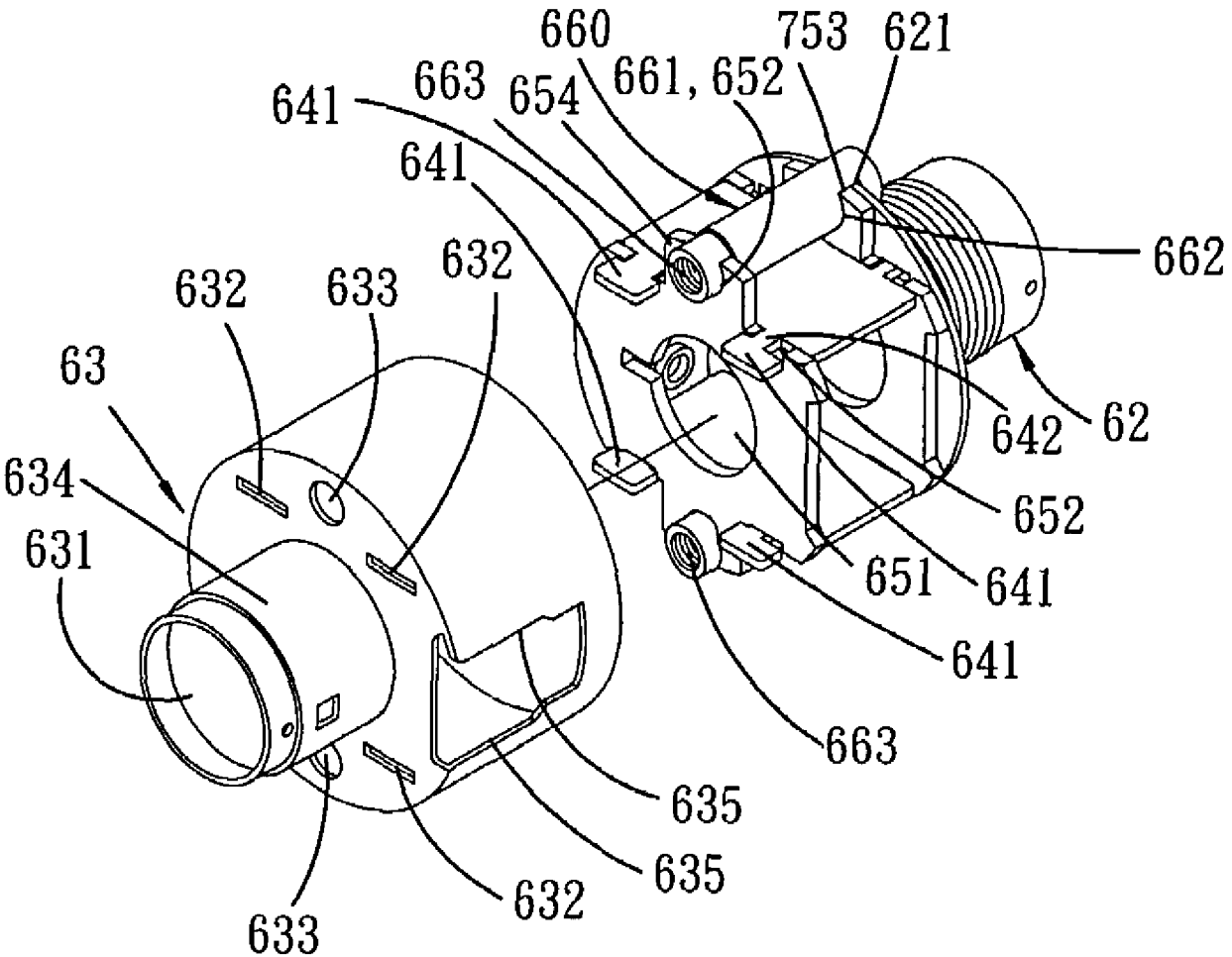
FIG. 4 is a partly exploded view showing that all parts of the drive mechanism are assembled together except an outer shell of the drive mechanism.
Figure 6:
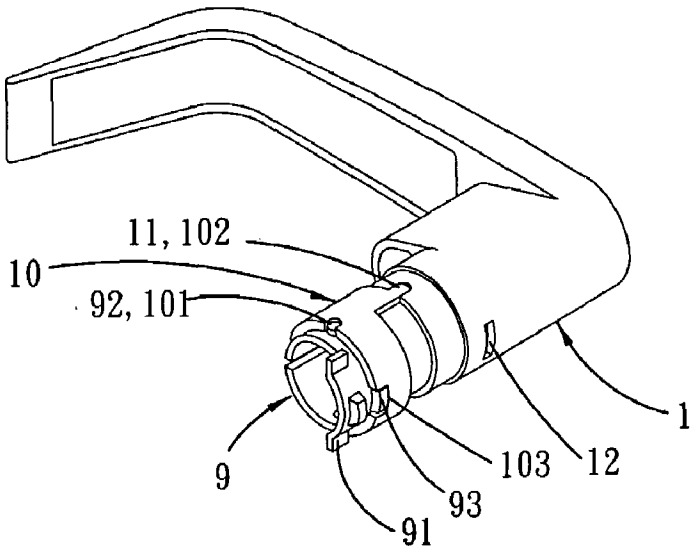
FIG. 6 is a perspective view showing the components of FIG. 5 in an assembled state.
Figure 5:
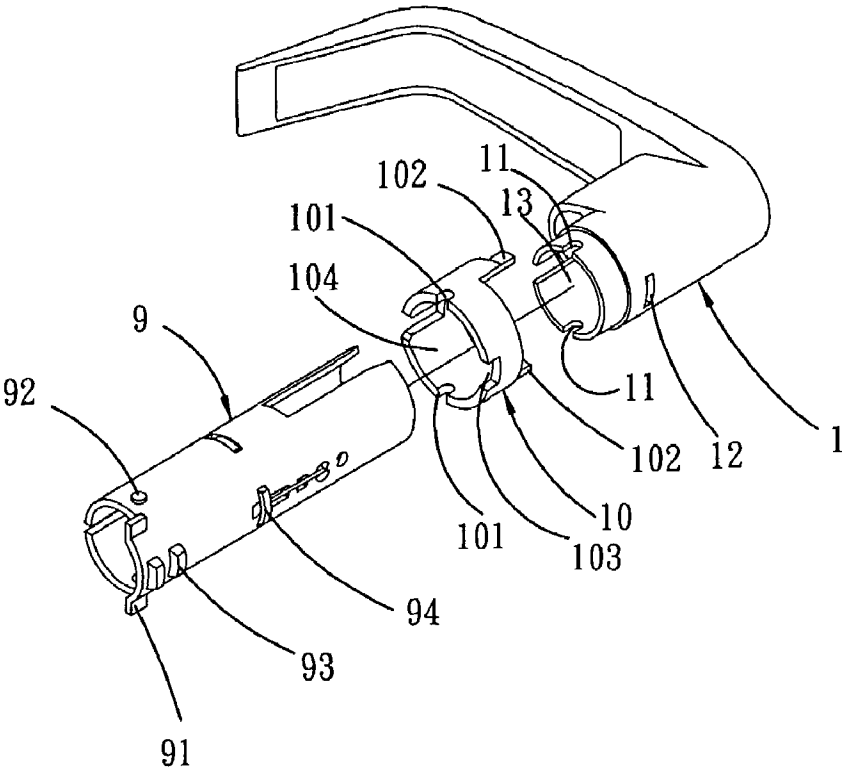
FIG. 5 is an exploded perspective view showing an outer handle, an outer drive spindle and a reinforcing ring.

Referring to FIGS. 2, 3 and 4 in combination with FIG. 1, the drive mechanism 6 includes a latch retractor housing 61 made up of a base 64, an inner cover plate 65, and an outer cover plate 75. The base 64 has upper and lower plates 644, and a vertical plate 645 connected between the upper and lower plates 644. The vertical plate 645 has two retention studs 643 (only one is shown). The upper and lower plates 644 bridge the inner and outer cover plates 65, 75. Each of the upper and lower plates 644 has two opposite ends respectively formed with two pairs of anchoring tabs 642. Each anchoring tab 642 has a hook 641. The anchoring tabs 642 extend outward through the inner and outer cover plates 65, 75.

The inner cover plate 65 has a central hole 651, and upper and lower projections 654 projecting from upper and lower edges of the inner cover plate 65. Each projection 654 has an edge notch 653. Indentations 652 are formed in the inner cover plate 65 at left and right sides of each projection 654 for passage of the respective anchoring tabs 642 of the upper and lower plates 644. The inner cover plate 65 is therefore coupled to the base 64.

The outer cover plate 75 has a central hole 751 and projections 754 projecting from upper and lower edges of the outer cover plate 75. Each projection 754 has an edge notch 753. Indentations 752 are formed in the outer cover plate 75 at left and right sides of each projection 754 for passage of the respective anchoring tabs 642 of the base 64. The outer cover plate 75 is thus coupled to the base 64. The inner and outer cover plates 65, 75 and the base 64 cooperate to form the latch retractor housing 61.

The latch retractor housing 61 encases a latch retractor 71 that has a linking part 713 to connect a latch mechanism 3 so that a latch 32 can be pulled inward. A receiving part 712 is provided at a rear side of the latch retractor 71. A bearing part 711 is disposed between the linking part 713 and the receiving part 712.

The latch retractor 71 further has a positioning member 72 which is provided with two retaining elements 721 and which is assembled within the receiving part 712, and two springs 73 each positioned between one of retaining elements 721 and one of the retention studs 643 of the base 64. The springs 73 serve as a resilient support for the latch retractor 71.

The drive mechanism 6 further includes an inner drive spindle 8, an outer drive spindle 9, a sleeve 62, an outer shell 63, a reinforcing ring 10, and two rigid coupling members 66.

The outer drive spindle 9 has a turning tab 91 at one end thereof to abut against the bearing part 711 of the latch retractor 71, two diametrically opposite first protrusions 92 (only one is shown) projecting radially from the outer drive spindle 9, and a second protrusion 93 projecting radially from the outer drive spindle 9 between the first protrusions 92. The first and second protrusions 92, 93 are proximate to the turning tab 91. The outer drive spindle 9 is inserted partially into a tubular end portion 13 of the outer handle 1. A resiliently supported handle retainer 94 is disposed at the middle of the outer drive spindle 9. When the outer drive spindle 9 is inserted into the tubular end portion 13 of the outer handle 1, the handle retainer 94 engages a slot 12 formed in the outer handle 1.

The inner drive spindle 8 has a turning tab 81 at one end thereof to abut against the bearing part 711 of the latch retractor 71. Another end of the inner drive spindle 8 is connected directly to the inner handle 2. The inner drive spindle 8 further has a spring-supported handle retainer 83. The handle retainer 83 engages a hole 22 in the inner handle 2 when the inner drive spindle 8 is inserted into a central hole 21 of the inner handle 2, thereby connecting the inner handle 2 to the inner drive spindle 8. A ring 82 is sleeved around the inner drive spindle 8.

The outer drive spindle 9 has a portion inserted into the tubular end portion 13 of the outer handle 1. The reinforcing ring 10 has a central hole 104 and is sleeved around another portion of the outer drive spindle 9. One end of the reinforcing ring 10 has two diametrically opposite first cutouts 101, and a second cutout 103 between the first cutouts 101. The other end of the reinforcing ring 10 has two diametrically opposite fingers 102 projecting axially therefrom. The first cutouts 101 engage the respective first protrusions 92 of the outer drive spindle 9, whereas the fingers 102 engage respectively third cutouts 11 that are formed in the tubular end portion 13 of the outer handle 1 at two diametrically opposite positions. The second cutout 103 of the reinforcing ring 10 engages the second protrusion 93 of the outer drive spindle 9.

The sleeve 62 is a hollow cylinder and has a central hole 623 for extension of the outer drive spindle 9. The sleeve 62 further has a flange 624 that extends annularly and radially from one end of the sleeve 62. A pair of edge notches 621 and four apertures 622 are formed in the flange 624. The apertures 622 permit extension of the hooks 641 of the base 64. The hooks 641 are bent after extending through the respective apertures 622 so that the sleeve 62 is fixed to the latch retractor housing 61. The edge notches 621 of the sleeve 62 are aligned axially with the respective edge notches 753 formed in the outer cover plate 75.

The rigid coupling members 66 are offset from and substantially parallel to a rotation axis of the inner and outer drive spindles 8, 9. Preferably, the rigid coupling members 66 are formed as tubes 660 which are disposed at two diametrically opposite positions and each of which engages the aligned edge notches 653, 753 of the latch retractor housing 61 and the edge notches 621 of the sleeve 62. Each tube 660 has two opposite ends respectively provided with circumferentially extending first and second slots 661, 662. The first slot 661 of each tube 660 engages the respective edge notch 653 in the inner cover plate 65, and the second slot 662 thereof engages the respective edge notch 753 on the outer cover plate 75 and the respective edge notch 621 in the sleeve 62. Each tube 66 further has an internal thread 663.

The outer shell 63 is substantially cylindrical and has a large tubular part 630, a small tubular part 634, and a shoulder plate 631 formed between the large and small tubular parts 630, 634. The shoulder plate 631 has four apertures 632, and two screw holes 633. The small tubular part 634 is sleeved around the inner driver spindle 8. The large tubular part 630 encases the latch retractor housing 61 by associating with the flange 624 of the sleeve 62.

The large tubular part 630 is disposed around the latch retractor housing 61, the anchoring tabs 642 extend through the inner and outer cover plates 65, 75, and the hooks 641 engaged in the respective apertures 622 in the flange 624 and the respective apertures 632 formed in the shoulder plate 631. The screw holes 633 in the shoulder plate 631 are aligned with the respective internal threads 663 of the tubes 660, and the screws 41 are inserted into the respective holes 42 of the inner rose 4, the respective screw holes 633 and the respective internal threads 663. The outer shell 63 further has a connecting part 635 in the large tubular part 630. The connecting part 635 engages hooks 31 (only one is shown) of the latch mechanism 3, whereas the linking part 713 of the latch retractor 71 is connected to the latch 32.

When the outer handle 1 is rotated to drive the outer drive spindle 9, the outer drive spindle 9 moves the latch retractor 71, thereby moving the latch 32 to a retracted position. When the outer handle 1 is released, the latch retractor 71 returns to its extended position by the action of the springs 73 so that the latch 32 returns to its protruding position. Because the rigid coupling members 66 (tubes 660) couple together the sleeve 62 and the inner and outer cover plates 65, 75, the entire assembly of the cylinder lock is reinforced in terms of torsional strength, compression strength and tensile strength so that the cylinder lock can resist stresses induced upon frequent movements of the outer handle 1 and the outer drive spindle 9.

Besides, as the reinforcing ring 10 provides a coupling force between the outer handle 1 and the outer drive spindle 9, the torsional strength of the outer drive spindle 9 is further increased. The reinforcing ring 10 may also be used to reinforce the inner drive spindle 8 by coupling the inner drive spindle 8 to the inner handle 2.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A cylinder lock comprising:

inner and outer roses;

inner and outer handles respectively extending through said inner and outer roses;

a latch retractor adapted to be connected to a latch;

a latch retractor housing receiving said latch retractor and having an inner cover plate and an outer cover plate opposite to said inner cover plate;

inner and outer drive spindles respectively connected to and driven by said inner and outer handles, and extending into said latch retractor housing to operate said latch retractor, said inner drive spindle extending through said inner cover plate;

a sleeve connected to said latch retractor housing and surrounding said outer drive spindle, said sleeve having a flange projecting radially from said sleeve and opposite to said inner cover plate, and said outer cover plate contacting said flange;

an outer shell surrounding said inner drive spindle and associated with said sleeve to encase said latch retractor housing; and at least one rigid coupling member disposed within said outer shell and substantially parallel to a rotation axis of said inner and outer drive spindles;

each of said inner cover plate and said flange having an edge notch, said edge notches of said inner cover plate and side flange being aligned with each other axially;

said rigid coupling member having two opposite ends respectively formed with first and second slots that extend transversely of said rigid coupling member and that engage respectively said edge notches of side inner cover plate and side flange.

2. The cylinder lock of claim 1, wherein said outer drive spindle extending through said outer cover plate, said outer cover plate having an edge notch aligned with said edge notches of said inner cover plate and said flange and engaging one of said opposite ends of said rigid coupling member.

3. The cylinder lock of claim 2, wherein said rigid coupling member is formed as a tube.

4. The cylinder lock of claim 3, wherein said first and second slots extend circumferentially in two opposite ends of said tube, said first slot engaging said edge notch formed in said inner cover plate, said second slot engaging said edge notches respectively formed in said outer cover plate and said flange.

5. The cylinder lock of claim 4, wherein a pair of said tubes are provided at two diametrically opposite positions.

6. The cylinder lock of claim 4, wherein said outer shell has a large tubular part encasing said latch retractor housing, a small tubular part surrounding said inner drive spindle, and a shoulder plate disposed between said large and small tubular parts, said tube extending to said shoulder plate and further having an internal thread, said tube further having a screw passing through said shoulder plate and engaging said internal thread.

7. The cylinder lock of claim 6, wherein said latch retractor housing further has upper and lower plates bridging said inner and outer cover plates, each of said upper and lower plates having one end extending through said inner cover plate and engaging said shoulder plate, and another end extending through said outer cover plate and engaging said flange.

8. The cylinder lock of claim 1, further comprising a reinforcing ring extending around said outer drive spindle to reinforce said outer drive spindle, said outer drive spindle having one end portion inserted into a tubular end portion of said outer handle, said reinforcing ring having two opposite ends respectively engaging said tubular end portion and another end portion of said outer drive spindle.

9. The cylinder lock of claim 8, wherein said another end portion of said outer drive spindle has two diametrically opposite first protrusions extending radially from said another end portion, said reinforcing ring further having two diametrically opposite first cutouts engaging said first protrusions, respectively.

10. The cylinder lock of claim 9, wherein said another end portion of said outer drive spindle further has a second protrusion projecting radially from said another end portion between said first protrusions, said reinforcing ring further having a second cutout engaging said second protrusion.

11. The cylinder lock of claim 9, wherein said tubular end portion of said outer handle has two diametrically opposite third cutouts, said reinforcing ring further having two diametrically opposite fingers that project axially from said reinforcing ring and that engage said third cutouts, respectively.

12. A cylinder lock comprising:

inner and outer handles;

a latch retractor adapted to be connected to a latch;

a latch retractor housing receiving said latch retractor;

a drive mechanism including inner and outer drive spindles respectively connected to said inner and outer handle and extending into said latch retractor housing to operate said latch retractor, said outer drive spindle having an end portion inserted into a tubular end portion of said outer handle;

a reinforcing ring sleeved around another end portion of said outer drive spindle to reinforce said outer drive spindle;

said another end portion of said outer drive spindle having at least one first protrusion extending radially from said another end portion;

said reinforcing ring having at least one first cutout engaging said first protrusion; and said reinforcing ring further having at least one finger projecting axially from said reinforcing ring and engaging said tubular end portion of said outer handle.

13. The cylinder lock of claim 12, wherein said another end portion of said outer drive spindle has two diametrically opposite said first protrusions extending radially from said another end portion, said reinforcing ring having two diametrically opposite said first cutouts engaging said first protrusions, respectively.

14. The cylinder lock of claim 13, wherein said another end portion of said outer drive spindle further has a second protrusion projecting radially from said another end portion between said first protrusions, said reinforcing ring further having a second cutout engaging said second protrusion.

15. The cylinder lock of claim 12, wherein said tubular end portion of said outer handle has at least one third cutout to engage said finger of said reinforcing ring.

16. The cylinder lock of claim 15, wherein said reinforcing ring has two diametrically opposite said fingers, and said tubular end portion has two diametrically opposite said third cutouts to engage said finger, respectively.

17. A cylinder lock comprising:

inner and outer roses;

inner and outer handles respectively extending through said inner and outer roses;

a latch retractor adapted to be connected to a latch;

a latch retractor housing receiving said latch retractor and having an inner cover plate and an outer cover plate opposite to said inner cover plate;

inner and outer drive spindles respectively connected to and driven by said inner and outer handles, and extending into said latch retractor housing to operate said latch retractor, said inner drive spindle extending through said inner cover plate;

a sleeve connected to said latch retractor housing and surrounding said outer drive spindle, said sleeve having a flange projecting radially from said sleeve and opposite to said inner cover plate, and said outer cover plate contacting said flange;

an outer shell surrounding said inner drive spindle and associated with said sleeve to encase said latch retractor housing, said outer shell having a large tubular part encasing said latch retractor housing, a small tubular part surrounding said inner drive spindle, and a shoulder plate disposed between said large and small tubular parts; and a pair of tubes disposed within said outer shell and substantially parallel to a rotation axis of said inner and outer drive spindles at two diametrically opposite positions;

each of said inner cover plate and said flange having a pair of edge notches, said edge notches of said inner cover plate and side flange being aligned with each other axially;

each of said tubes having two opposite ends respectively formed with circumferentially extending first and second slots respectively engaging one of said edge notches of said inner cover plate and one of said edge notches of said flange;

one of said opposite ends of each of said tubes that has said first slot passing through said inner cover plate and being secured to said shoulder plate.

18. The cylinder lock of claim 17, wherein said one of said opposite ends of each of said tubes has an internal thread, and a screw passing through said shoulder plate and engaging said internal thread.

* * * * *